United States Patent [19]

Ackley

[11] Patent Number: 5,010,610

[45] Date of Patent: Apr. 30, 1991

[54] MULTILAYER SUPPLEMENTAL SUPPORT PAD

[75] Inventor: Robert E. Ackley, Greenville, S.C.

[73] Assignee: Span-America Medical Systems, Inc., Greenville, S.C.

[21] Appl. No.: 463,338

[22] Filed: Jan. 10, 1990

[51] Int. Cl.[5] ..... A47G 9/06; A47G 9/00; A47C 27/14

[52] U.S. Cl. ..... 5/481; 5/420; 5/502

[58] Field of Search ..... 5/420, 481, 500, 502, 5/417, 418, 419, 482

[56] References Cited

U.S. PATENT DOCUMENTS

| | | | |
|---|---|---|---|
| 4,305,988 | 12/1981 | Kocher | 428/158 |
| 4,329,747 | 5/1982 | Russell | 5/420 |
| 4,333,978 | 6/1982 | Kocher | 428/158 |
| 4,375,111 | 3/1983 | Hall | 5/420 |
| 4,603,445 | 8/1986 | Spann | 5/481 |
| 4,686,725 | 8/1987 | Mitchell | 5/481 |
| 4,700,447 | 10/1987 | Spann | 29/418 |
| 4,738,545 | 4/1988 | Westgor | 5/420 |
| 4,862,538 | 9/1989 | Spann et al. | 5/464 |

*Primary Examiner*—Alexander Grosz
*Attorney, Agent, or Firm*—Dority & Manning

[57] ABSTRACT

A multilayer supplemental support pad includes a generally planar layer of foam surrounded by fabric material. Lateral stitching forms channels in the pad to facilitate rolling up of the pad for storage and transportation. Elastic straps secure the rolled up pad. Other straps may be used when the pad is unrolled to secure the pad to a chaise lounge or other support surface. Different types of fabrics and pads of different dimensions may be used to provide pads for alternative purposes. When used as a chaise lounge pad, an approximately one-half inch thick layer of foam cut into a twenty inch by seventy inch rectangle is preferred, with cotton terry cloth fabric on at least one side of the pad. Fabric edging stitched to the periphery of the pad reinforces lateral edges of the main stitching.

19 Claims, 3 Drawing Sheets

MULTILAYER SUPPLEMENTAL SUPPORT PAD

BACKGROUND OF THE INVENTION

This invention relates to an improved supplemental support pad in general, and in particular to a multilayer pad having a central foam layer encased in fabric material and secured together by stitching.

Foam materials are widely used and well known for being incorporated into mattresses or mattress supplements for resilient support of persons. Numerous products are available in both commercial and medical markets to be placed on top of an existing mattress or other support surface as a supplement thereto. Typically such mattress cushions comprise a layer of foam material, such as several inches thick or more, with various cuts or incorporating other surface and subsurface features for improved performance. Such mattress cushions generally do not have their own fabric coverings and are not intended to be rolled up and transported to different locations. Several patents assigned to the present Assignee and illustrating examples of foam support pads are U.S. Pat. Nos. 4,603,445 (Spann, issued Aug. 5, 1986); 4,686,725 (Mitchell, issued Aug. 18, 1987); 4,700,447 (Spann, issued Oct. 20, 1987); and 4,862,538 (Spann et al., issued Sept. 5, 1989).

As manufacturers have attempted to incorporate the advantages of foam into different products, various coverings or the like have been applied to foam. For example, Kocher (U.S. Pat. Nos. 4,305,988 and 4,333,978) relate to a finished product comprising a plurality of foam cables in parallel and respectively surrounded by ultrasonically weldable materials which are ultrasonically spot welded to each other along substantially parallel, spaced apart weld seams. The foam cables or other strands of material are not ultrasonically weldable, and must be arranged in strips so that the weld seams may be created between adjacent strands or cables. In general, a finished product created with such methodology can be made into different sized products, such as a stadium cushion, chaise lounge cover, or exercise pad. It has been known to roll up commercial products of such construction and secure their rolled up condition with straps or the like. However, the technique completely prevents providing a product with an integral or continuous foam layer, or one which has natural fabric coverings or other materials which are not ultrasonically weldable. Also, irregular weld spots or failed weld spots obviously result in deficiencies in the finished product.

Natural fabric material can in general provide numerous desired features and advantages as a covering for a support surface for a person. For example, it is well known to place a towel, such as made of cotton terry cloth material or the like, across a chair or chaise lounge, or directly onto a ground surface such as sand at the beach or grass at a picnic. Absorbency and washability are two important advantages of such material for such uses. Breathability of the material is also an advantage, and terry cloth material with fitted corners have been adapted for use directly on chaise lounges.

Some manufacturers have attempted to combine the advantages of foam and fabric. For example, a beach matt product of Sure Fit products of Bethlehem, Pa., comprises a solid foam piece surrounded by a terry zippered case, which is removable to permit the terry cloth to be washed. The terry cloth is polyester rather than cotton or other natural fabric and so does not have breathability or absorbability advantages. Furthermore, the only securement of the outside cover to the solid foam pad is the zippered pillowcase type arrangement, which would not prevent bunching, gathering, or other problems. Also, no straps of any type are provided for either securing the pad to a chair or maintaining the pad in a rolled up condition. Without any form of stitching, the pad is not particularly adapted to be rolled up. In fact, attempts to roll up such a pad could exacerbate fit problems between the relatively loose cover and the foam piece.

Particularly in connection with very inexpensive exercise pads, diaper changing pads, or the like, it has been known to cover sections of foam with vinyl, with the resulting pad being foldable along the foam sections due to formation of vinyl "hinges" between such sections. Foam covered with vinyl is generally not capable of being rolled up and can only be folded at such "hinges." One attempt to solve this problem by the manufacturer of a molded exercise pad has been to create panels of descending size in a longitudinal direction of the pad. The pad cannot roll up, but can be folded up in triangles. It has also been known to combine a foam piece with vinyl on one side and terry cloth on another for use on such as chaise lounges. No stitching or quilting is provided in such structure so that foldability and fit problems still persist.

Another common problem with vinyl covered foam exercise pads is that folded vinyl strips have been secured as edging about the periphery of the foam layer. Such vinyl edging frequently is less durable than desired, particularly as relates to its continued securement to the pad. Vinyl edging which is repeatedly bent, such as adjacent to fold lines of a vinyl covered foam pad, frequently will work loose from the pad. Also, stitching generally does not hold well to the vinyl.

It has been generally known to stitch fabric to foam or some other resilient material, in connection with automobile upholstery or similar. Virtually any multineedle quilting machine can perform such stitching, which is typically in straight lines or channels in automobile upholstery materials. Stitching of such materials may also be used in the ticking of a mattress, but most frequently quilting on such products is in the form of some ornamental pattern rather than a straight line. Obviously, neither conventional mattress products nor automobile upholstery products are suitable for portable use as a supplemental support pad for chaise lounges, stadium seats, or as exercise pads, diaper changing pads, or the like.

SUMMARY OF THE INVENTION

The present invention recognizes and addresses various of the foregoing problems and others, concerning support pads in general. Thus, broadly speaking, a principal object of this invention is to provide an improved supplemental support pad. More particularly, it is an object to provide an improved multilayer supplemental support pad combining advantages of both foam and fabric materials.

It is another more particular object of this invention to provide an improved supplemental support pad which is adapted to be rolled up for easy storage, transportation, or the like. It is also a present object to provide such a portable support pad which may be machine washable.

It is yet another present object to provide a supplemental support pad which may be embodied in various sizes to suit various needs, such as for use as a chaise lounge covering, a stadium cushion, an exercise pad, a diaper changing pad, or to serve other purposes.

It is yet another present and more particular object to provide such a fabric-encased foam supplemental support pad which includes various strap members, such as for securement of the pad to a chaise lounge or the like, or for maintaining the pad in a rolled-up condition.

It is another present object to provide such an improved support pad which may be readily manufactured, and which has improved durability over previous pads which attempted to encase foam and various materials. A more particular object is to provide a pad with improved durability which has greater integrity and strength by incorporation of an integral (i.e., one-piece) foam pad and use of stitching. Another object is inclusion of improved edge features.

Additional objects and advantages of the invention are set forth, or will be apparent to those of ordinary skill in the art, from the detailed description which follows. Also, it should be appreciated that modifications and variations to the specifically illustrated and discussed features hereof may be practiced in various embodiments and uses of this invention without departing from the spirit and scope thereof, by virtue of present reference thereto. Such variations may include, but are not limited to, substitution of equivalent means, features, and materials for those shown or discussed, and the functional or positional reversal of various features, or the like.

Still further, it is to be understood that different embodiments, as well as different presently preferred embodiments, of the present invention may include various combinations of presently disclosed features, or their equivalents (including combinations not expressly shown or stated). One exemplary such embodiment of the present invention relates to a multilayer supplemental support pad, comprising first and second generally planar layers of fabric material; a layer of foam received between the first and second fabric material layers, and comprising essentially one piece of foam material; and patterned stitching through the support pad for securing the layers of fabric and foam together.

Another present exemplary embodiment concerns a portable support pad comprising an integral foam member, fabric coverings, stitching, and strap means. The integral foam member preferably comprises a generally rectangular shaped planar layer. The fabric coverings are preferably received on both sides of the foam member layer and received about the edges of such layer so that the foam member is fully encased. The stitching preferably resides in generally straight lines existing through the pad at spaced intervals therealong, and extending laterally relative the generally rectangular shaped foam member layer. Such stitching facilitates rolling up the pad in a longitudinal direction perpendicular to the direction to the stitching. The strap means are preferably connected to the pad and functional when the pad is rolled up for maintaining such in its rolled-up condition.

Yet another construction comprising an exemplary embodiment of this invention includes a padded removable covering for a chaise lounge or similar primary support. Such covering comprises a fabric-encased integral foam layer with stitching therethrough to secure the fabric to the foam layer. Furthermore, the stitching is preferably in spaced substantially straight lines so as to form channels which facilitate rolling up the covering. Additionally, the fabric is preferably washable.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
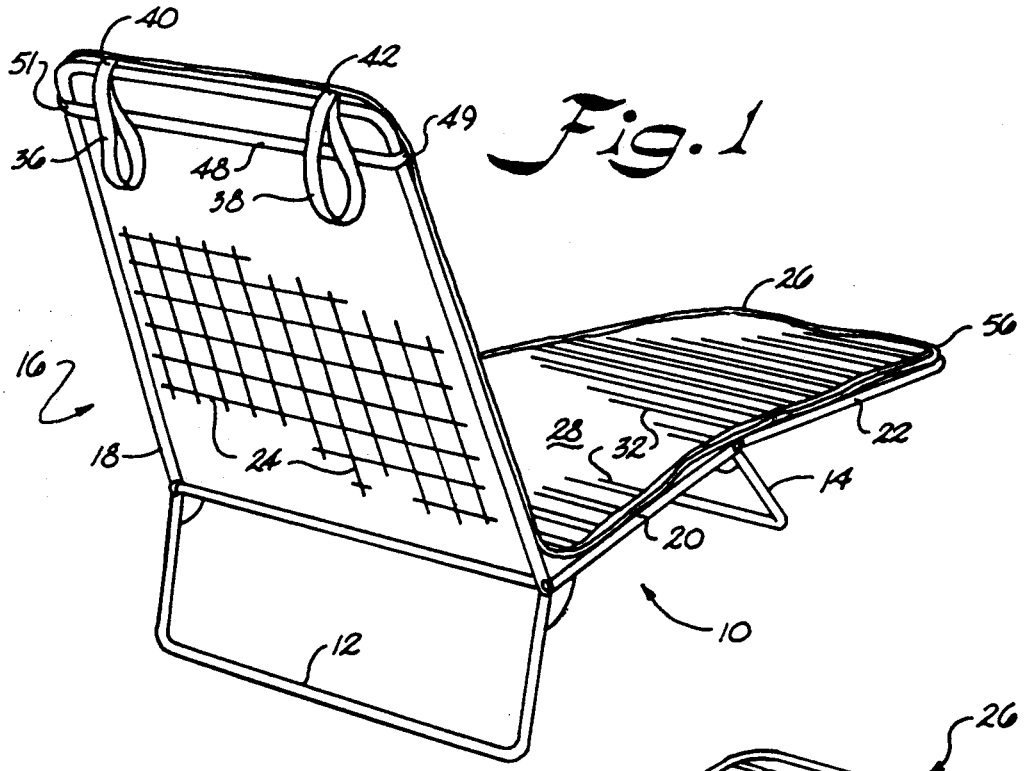
FIG. 1 is a generally rearward perspective view of an exemplary embodiment of the present invention adapted as a chaise lounge covering and supported on an exemplary conventional chaise lounge.

Repeat use of reference characters throughout the present specification and appended drawings is intended to represent same or analogous features or elements of the invention.

DETAILED DESCRIPTION OF THE PREFERRED EMBODIMENTS

In order to facilitate discussion of this invention various specific exemplary embodiments are illustrated in the accompanying drawings and discussed hereinafter. Those of ordinary skill in the art will appreciate that broader aspects of this invention are not strictly limited to only the exemplary embodiments illustrated. For example, FIGS. 1 and 2 pertain to a first embodiment particularly adapted for selected use on a conventional chaise lounge 10.

Various aluminum or other metal, plastic, or wood folding furniture constructions are well known and used in a variety of settings, e.g., at the beach, or on a picnic, on decks, and tailgating at football games, etc. The exemplary chaise lounge 10 is representative of a typical folding aluminum lounge having legs 12 and 14 which support a primary frame 16 having different sections thereof, such as 18, 20, and 22. Typically such primary support sections include plastic or synthetic fabric or other material webbing 24 about the frame for providing a primary support surface for a user for sitting, sunbathing, resting, etc. Construction details of conventional chaise lounges, chairs, etc., are well known and form no particular aspects of this invention. Thus no further description thereof is necessary.

In accordance with the present invention a multilayer supplemental support pad 26 (see FIGS. 1 and 2) is provided. As specifically illustrated in FIG. 1, such exemplary only support pad is of approximately 20 inches by 70 inches in rectangular dimensions so as to be adapted for fitting on the primary support surface formed by conventional chaise lounge 10. The multilayer construction of exemplary support pad 26 will be discussed in detail below in conjunction with the description of FIGS. 6 through 8. However, in general it is preferred that such pad comprise a fabric-encased integral (i.e., one-piece) foam layer with stitching therethrough for securing the fabric to the foam layer. Pad 26 is preferably of a generally planar construction.

Top surface 28 is preferably a terry cloth fabric or similar natural material whenever pad 26 is constructed as a chaise lounge pad or similar article. Such a construction provides the attributes and advantages of a natural fabric for breathability, absorption, evaporation, comfort, washability, etc. Support pad 26 can incorporate either a similar or dissimilar material (i.e., natural fabric or manmade) for forming the reverse side 30 thereof (see FIG. 2). Final selection of the type of fabric for side 30 may be made dependent on the intended use of the pad.

Figure 2:
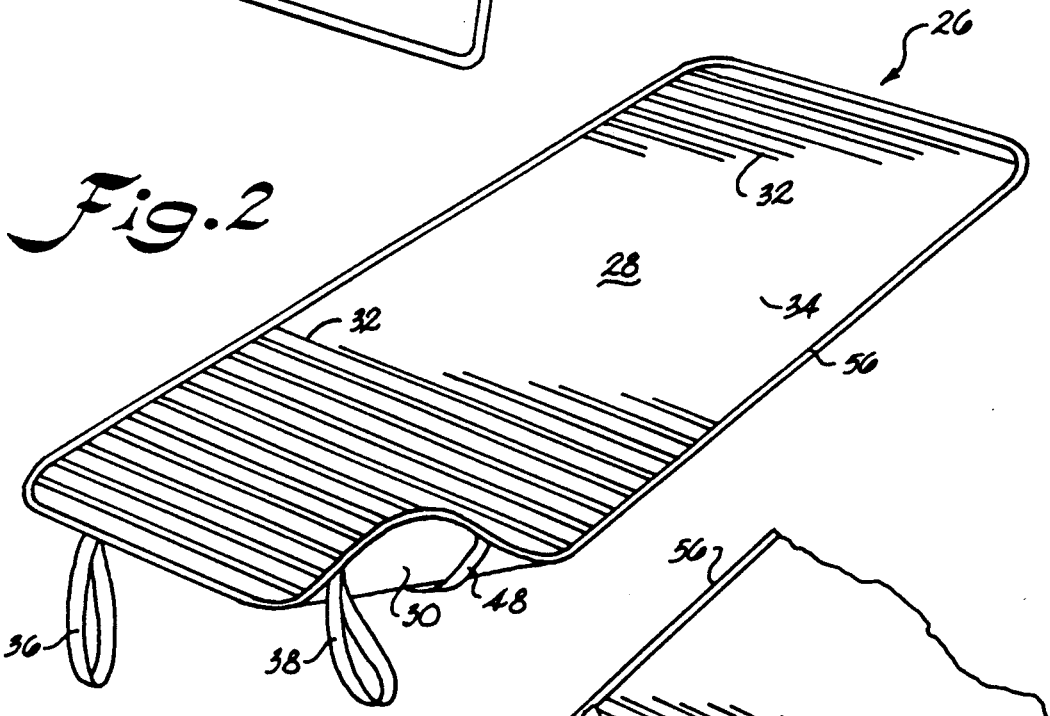
FIG. 2 is a generally top perspective view of the embodiment of present FIG. 1 supported as if on a flat surface such as the ground.

For clarity in illustrating various strap features of the invention, no stitch patterns are illustrated on the upturned lip of pad 26 as shown in FIG. 2. However, it is preferred that the patterned stitching 32 extend through the entire pad, including the fabric coverings thereof and the foam layer encased therebetween as discussed below. Such stitching is preferably in substantially straight lines spaced at predetermined intervals, as represented in FIGS. 1 and 2. The direction of such straight line stitching is preferably generally perpendicular to the longitudinal axis 34 of pad 26 so as to facilitate rolling up the pad in the direction of such longitudinal axis (see FIG. 4).

Figure 4:
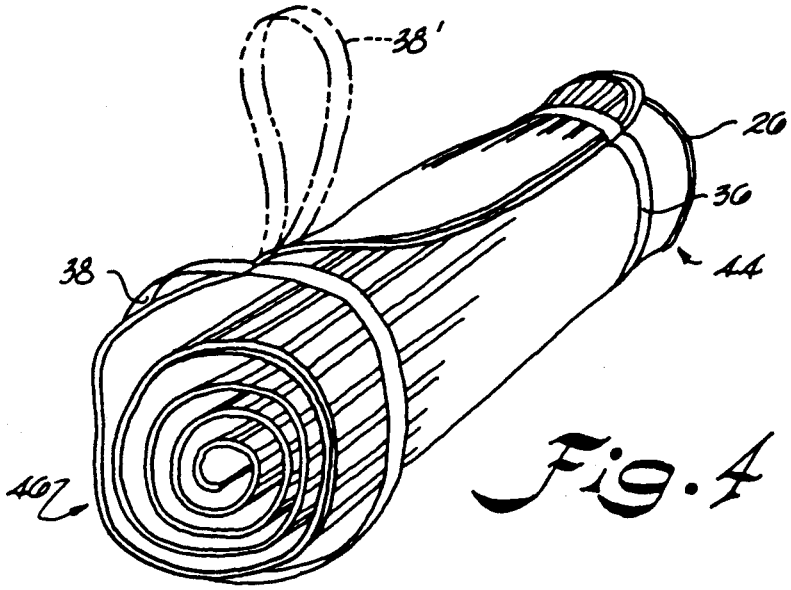
FIG. 4 is a generally end perspective view of an exemplary embodiment of this invention in a substantially rolled-up condition with strap means secured thereabout.

Various strap means are illustrated in both FIGS. 1 and 2 for providing different functions. For example, straps 36 and 38 each comprise a band with its respective ends secured at common points 40 and 42 on pad 26. With such a construction, each band may be placed in a loop about the pad whenever the pad is in its rolled-up condition, such as in present FIG. 4. FIG. 4 represents in solid line such a pad 26 in substantially rolled-up condition. One lateral end 44 of the rolled-up pad has a strap 36 looped thereabout. Such strap-is preferably of elastic material (of for example about one inch wide construction) so as to best hold the pad in its rolled-up state. The opposite end 46 of the rolled-up pad is represented with a strap 38 just being secured thereabout. The dotted line illustration of strap 38' in FIG. 4 represents how such strap is situated before being turned essentially inside out and looped about end 46. Alternative strap means such as ties, Velcro secured straps, or with buttons, snaps, etc., may also be practiced in place of either one or both of straps 36 and 38. Likewise, the number, size, and placement of such straps may be varied while remaining within the spirit and scope of the present invention.

Further strap means 48 are represented in both FIGS. 1 and 2 and again preferably comprise an elastic band approximately one inch wide. The purpose and function of strap means 48 is to secure pad 26 in a desired position on chaise lounge 10. As represented in FIG. 1, ends 49 and 51 are secured to pad 26, and strap means 48 is adapted for being fitted about one end of an upper support section 18 of chaise lounge 10. It will be apparent to those of ordinary skill in the art that pad 26 could just as easily be supported on chaise lounge 10 with strap means 48 secured about the opposite end of chaise lounge 10, i.e., support section 22 thereof. However, it is preferred (but not a necessity) that strap means 48 be located on the same end of pad 26 as straps 36 and 38 thereof, and that strap means 48 be secured to the head end of chaise lounge 10 so as to keep all straps free and clear of debris, or other material on the ground whenever pad 26 is used outside.

It will be equally appreciated by those of ordinary skill in the art that an additional strap means 48 may be provided in accordance with this invention on the opposite end of pad 26 so that such pad may be secured at both its ends. It is still further to be understood that alternative placements and configurations of strap means may be provided to accommodate use of pad 26 with other chairs, other furniture, or other primary support surfaces, all of which may be selected by the user as a matter of design choice within the spirit and scope of this invention.

Figure 3:
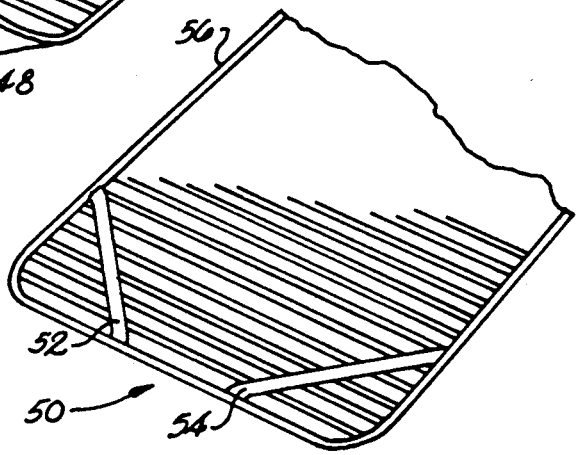
FIG. 3 is a perspective, partial view of an alternative embodiment of this invention with different strap means included therewith.

Present FIG. 3 is a perspective view of a partial alternative support pad 50 in accordance with this invention. The primary difference between exemplary pad 50 and exemplary pad 26 is that different strap means are shown. Also, with the alternative strap means configuration of present FIG. 3, it is possible to combine the functions of straps 36, 38, and 48 into a single pair of straps 52 and 54. Again it is preferred that such straps be made of elastic material approximately one inch wide. By positioning straps 52 and 54 diagonally across one side of pad 50, the pair of straps in cooperation serve to alternately secure pad 50 to a chaise lounge or the like, and to secure edges of the pad when it is rolled up for maintaining such condition.

FIGS. 1 through 3 also illustrate a preferred fabric edging 56 situated about the entire periphery of pads 26 and 50. Such fabric edging forms a further part of the preferred fabric covering for an integral foam layer in accordance with this invention and is also preferably stitched to the remaining construction, as discussed further below in detail with reference to present FIG. 6. It is also preferred that fabric edging 56 comprise terry cloth material, or some other material matching that of support surface 28 for a given pad.

Figure 5A:
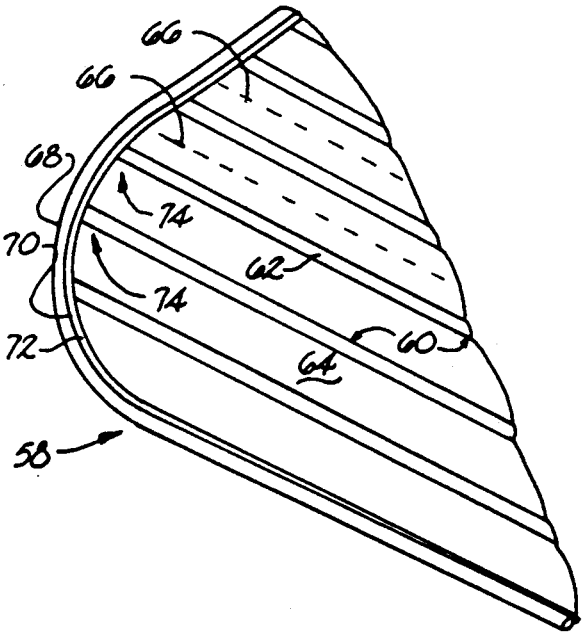
FIGS. 5A and 5B are enlarged, partial views of two different embodiments of this invention illustrating alternative stitching patterns thereof.
Figure 5B:
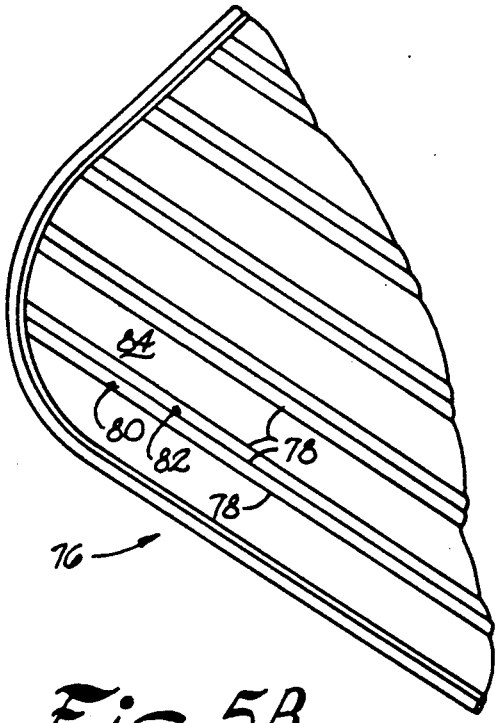

FIGS. 1 through 3 only generally represent preferred straight-line, lateral direction patterned stitching for holding a fabric covering and foam layer together. Present FIGS. 5A and 5B illustrate enlarged partial views of support pads 58 and 76, respectively, illustrating in greater detail the stitching patterns thereof. Generally straight-line, substantially lateral stitching combined with a one-piece foam layer performs at least two important functions. First, such stitching holds together the multilayer pads 58 or 76 as a durable, integral unit.

Secondly, because of the substantially lateral direction of such stitching (and the resulting channels formed by patterned spacing of such stitching), rolling up of pad 58 in its defined longitudinal direction (perpendicular to the lateral direction) is facilitated. This is particularly important to achieving such roll-up feature since a preferably integral foam layer is being rolled-up. Also, by incorporating patterned stitching to achieve such roll-up feature, considerable manufacturing advantages are obtained since the integral foam layer does not have to be cut into strips, strands, cords, or the like which would compound manufacturing effort due to initial cutting of the foam and subsequent separate handling of the resulting strips.

Those of ordinary skill in the art will appreciate that some deviation from absolute straight-line stitching as well as some deviation from substantially lateral directions of same, may be tolerated within the broader aspects of this invention so long as generally lateral channels within certain widths are formed in the pad.

FIG. 5A illustrates substantially lateral stitching 60 which is in a predetermined pattern. As illustrated in solid line, such pattern results in alternating channels 62 and 64 of approximately 1:2 relative ratio. In other words, the width of the resulting channel 64 is generally about twice that of the resulting channel 62. Additional stitching 66 (shown in dotted line in FIG. 5A) may be provided so that all of the resulting channels are generally of about the same width.

As referenced above, pads of different rectangular size, or other shapes, may be provided in accordance with this invention with the precise selection of dimensions and shapes subject to design choice by the user of the invention. Likewise, rounded edges or other such minor features are subject to user selection without departing from the spirit and scope of this invention. Within constraints referenced above, the user may also select the precise channel widths resulting from stitching 60 (or 60 and 66 combined) in a given pad. Whenever all or most of the stitching intervals are substantially the same, preferably the intervals (or channel widths) are generally in a range from about one-half of an inch to about two and one-half inches. Whenever the intervals alternate in the 1:2 relative ratio of exemplary channels 62 and 64, the smaller width channel may preferably be about one inch wide (or some range thereabout), with a resulting about two inch wide larger width channel.

FIG. 5A further illustrates fabric edging 68 secured about the periphery of pad 58, and having preferably a width of generally in a range from about one-quarter of an inch to about three-quarters of an inch. Such edging 68 is secured by stitching such as in either a single or double rows (see exemplary double rows 70 and 72). Such fabric edging significantly increases the durability of the overall integral pad 58 such as by securing lateral ends 74 of the stitching which holds the multilayer pad together.

FIG. 5B illustrates another exemplary embodiment in accordance with this invention. Pad 76 thereof is generally similar to previously discussed pads, but with a different stitching pattern therein. In particular, the pattern of resulting channels 80, 82, and 84 formed by such stitching 78 are in 1:1:2 relative ratios. The same exemplary preferred ranges apply thereto as discussed above with reference to effective channels 62 and 64 of the embodiment of FIG. 5A.

Figure 6:
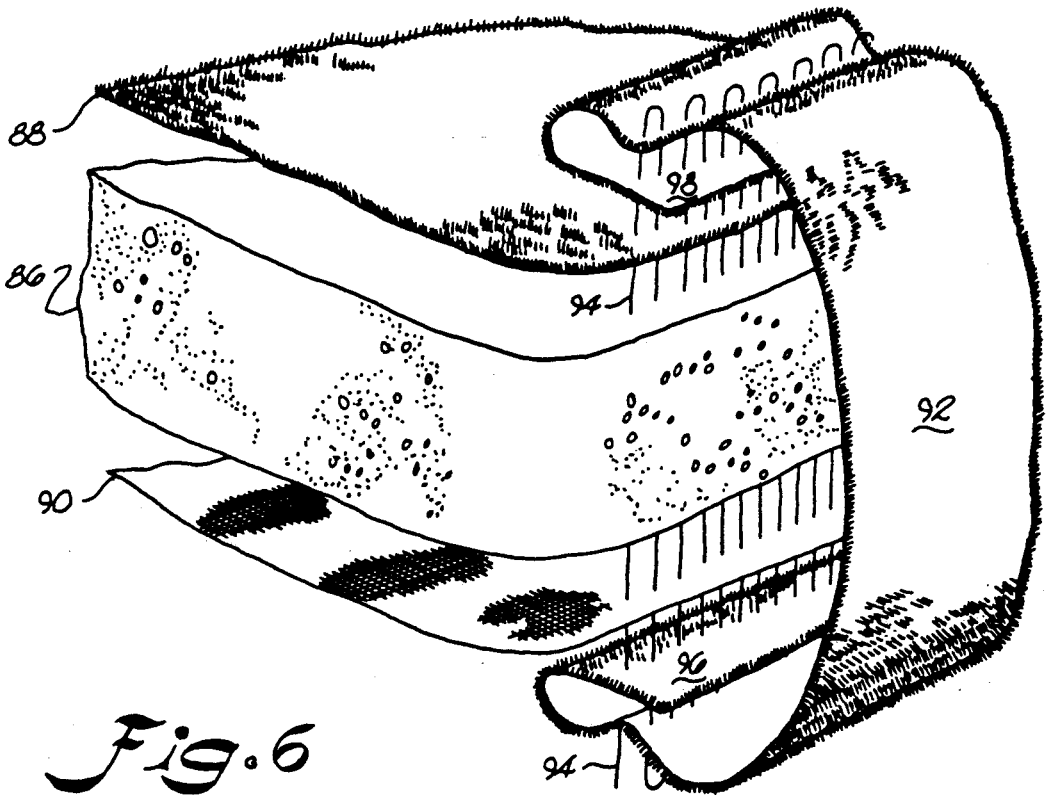
FIG. 6 is an enlarged, partial, exploded view of a present exemplary embodiment illustrating the construction thereof, including exemplary present edge features.

FIG. 6 illustrates an exploded perspective view of part of a multilayer support pad in accordance with this invention. As illustrated, a middle resilient layer 86 of generally planar construction is surrounded on opposing planar sides thereof by first and second generally planar layers 88 and 90 of fabric material. As represented in FIG. 6, at least layer 88 comprises a natural material such as terry cloth, whenever the pad is intended to be used as a chaise lounge covering (as in present FIG. 1) or similar article. Fabric layer 90 represents use of a manmade fabric such as polyester or tricot. Depending on desired features of given embodiments of this invention, fabric layer 90 may comprise natural materials instead, such as cotton terry cloth or cotton broadcloth or the like.

Resilient layer 86 preferably comprises a foam material, such as polyurethane foam. Such layer of foam may be generally flat as illustrated in FIG. 6. Alternative constructions may be used as discussed below with reference to FIG. 8. To achieve the overall desired functions of a portable support pad, it is preferred that such layer of foam 86 be generally about one-half of an inch thick, which facilitates rolling up such pad. A range of foam layer thicknesses may, however, be practiced, preferably in a range from about one-fourth of an inch to about one inch, with user preferences and various design constraints for given embodiments guiding the final determinations.

For clarity in illustration, stitching which secures the first and second layers of fabric material to the encased foam layer is not illustrated in present FIG. 6. However, such stitching may be generally of the same stitch type as used to secure fabric edging to the pad, which is represented generally in FIG. 6. Such fabric edging 92 preferably fits around the periphery of the entire pad, and about the outer faces of layers 88 and 90 of fabric material. Such positioning also reinforces lateral ends of stitching in such layers 86, 88, and 90. A lock stitch or other stitch type may be used for stitching 94. A double row of such stitching may be used as represented in present FIGS. 5A and 5B, or a single row may be adequate, as represented in present FIG. 6.

Preferably the side edges 96 and 98 of fabric edging 92 are turned under to provide a smooth exterior finish. Also, material 92 preferably comprises the same material as that forming layer 88, such as natural terry cloth material. Other materials may, of course, be practiced, including materials dissimilar from that comprising layer 88. Layer 90 may likewise comprise a dissimilar material which varies from one embodiment to another. For example, layer 90 may comprise nonskid material, such as with a rubber backing, or the like, for exercise pad embodiments of the invention.

Figure 7:
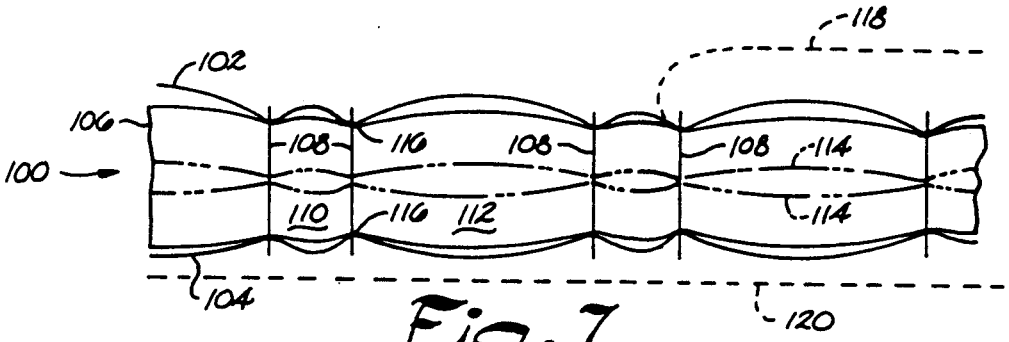
FIG. 7 is a partial, longitudinal axis cross-sectional view of a present exemplary embodiment.

FIG. 7 represents a partial, cross-sectional view of an exemplary support pad in accordance with the present invention, taken along the generally longitudinal axis of such pad. The cross section is relatively centrally located so that details of any edging features used do not interfere with illustration of other present features. FIG. 7 illustrates a pad 100 in accordance with this invention, in which separation between adjacent layers is exaggerated for clarity in the cross-sectional view.

A first fabric material layer 102 cooperates with a second fabric material layer 104 so as to encase an integral foam member comprising generally rectangular shaped planar layer 106. Solid lines 108 represent stitching which interconnects the multiple layers 102, 104, and 106, as generally described above. As with other embodiments, the predetermined amount of spacing between adjacent lines of stitching 108 in essence defines channels of alternating sizes 110 and 112 along the length of pad 100. Normally there are no gaps between layer 106 and layers 102 and 104, respectively. Gaps are illustrated in FIG. 7 for clarity in illustrating the separate layers.

Dotted lines 114, running laterally along the length of pad 100 generally about the centerline of foam layer 106, do not represent physical structures but instead represent the general compression which tends to take place within the resilient foam along stitching 108. In other words, the foam pad tends to be compressed where the stitching is located so that the typical shape of channels 110 and 112 are more like the profiles exhibited by the FIG. 7 view of layers 102 and 104. The amount of gathering of the foam would generally result in a visual appearance for the pad as shown by the outline of layers 102 and 104 of FIG. 7, with the resilient foam material 106 gathered into points 116 and extending outwardly against the fabric layers.

FIG. 7 further represent alternative features of this invention which may be optionally used with various embodiments thereof. For example, dotted line 118 represents a fabric covered foam pillow or the like which may be sown directly to pad 100 so as to occupy a space such as opposite strap means 48 in present FIG. 1. In such a position (i.e., on side 28 of pad 26) the pillow would be ideally located for supporting a user's head or head and neck. Other positions and other pillow constructions may be practiced.

Dotted line 120 represents a further layer which may be optionally provided to cover one side of pad 100, or to further encase such pad. Layer 120 preferably comprises an air permeable, water impermeable material, such as sold by the present Assignee under the trademark "SOFTSKIN." Such an added layer is particularly useful with embodiments of the present invention comprising pads for infants, such as changing pads or cribs pads. When configured as shown in FIG. 7 (i.e., with layer 120 on the bottom of pad 100), the moisture resistant air breathable layer prevents juices or the like from a baby bottle, or other fluids from the baby's body spoiling mattress cloths and mattresses beneath pad 100. At the same time, a soft, washable layer 102 such as cotton terry cloth may be provided for maximum comfort for the baby combined with utility of pad 100. Such a resulting padded removable covering may be made in virtually any needed size for fitting different size mattresses, cribs, bassinets, or the like.

Figure 8:
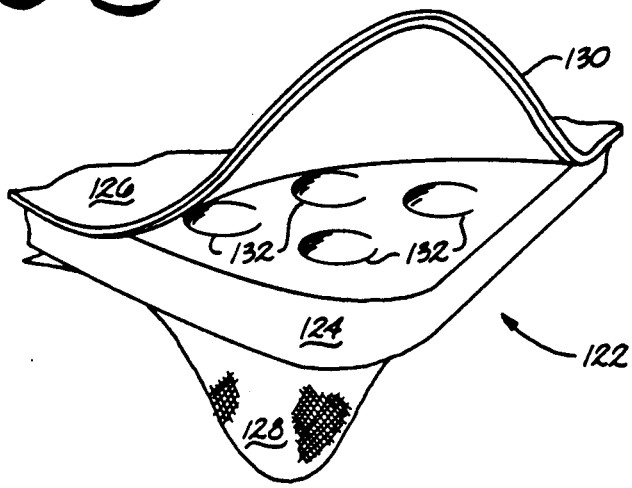
FIG. 8 is a partial perspective view of an alternative embodiment, with the fabric thereto partially turned back to reveal an alternative foam layer in accordance with this invention.

FIG. 8 represents a further alternate embodiment of this invention wherein a pad 122 includes a central foam layer 124 surrounded by a first fabric layer 126 and second fabric layer 128. Edging 130 may also be present. FIG. 8 illustrates a partially exploded view of a corner of such a pad, i.e., with layers 126 and 128 peeled back from the foam layer, to reveal convolutions 132 formed in foam layer 124. Such convolutions are an alternative to the generally flat foam layers discussed above. For purposes of the present invention, foam layer 124 of FIG. 8 is still regarded as a generally planar layer, though such layer may incorporate convolutions, or other cuts, channels, or other physical characteristics for improved resilient support. An example of a generally planar support layer with convolutions thereon is shown in U.S. Pat. No. 4,686,725, by Mitchell, entitled "MATTRESS CUSHION WITH SECUREMENT FEATURE," commonly assigned with this application. A different type of multi-section foam pad of generally planar construction and integrally formed, is shown by U.S. Pat. No. 4,862,538, issued to Spann et al., and commonly assigned with this application. Yet another generally planar support pad which comprises an integral or one-piece foam construction, is shown by U.S. Pat. No. 4,603,445, issued to Spann, and commonly assigned with this application. All such patents are referred to in the Background of the Invention, supra. The disclosures of such patents are incorporated herein by reference.

Those of ordinary skill in the art will appreciate various modifications and variations to the foregoing exemplary embodiments which may be practiced within the scope of this invention. For example, the fabric layers 102 and 104 as represented in FIG. 7, or in any of the other embodiments, may constitute seamed materials, of different colors, patterns, or different fabrics. For example, some bolts of material are only available in sixty inch widths and products of greater width could be made by seaming the fabrics layers while keeping the foam layer encased therein as an integral, or one-piece, construction in accordance with this invention. Since the fabric coverings and even the edging features (when used) are in some fashion attached to (directly or indirectly) the central, integral foam layer (see FIG. 6), a substantial and durable product results. Such result is great improvement over portable supplements which use strands or other filler materials which can move within the pad, or which make use of separated strands of foam so that no integral aspect of the construction exist.

Furthermore, while specific exemplary constructions have been discussed, those of ordinary skill in the art will be aware of numerous variations in materials which may be used for the fabric layers, including the fabric edging, and likewise variations in the foam or resilient layers used. Embodiments of this invention may use all manmade materials of various types (integrally throughout, or intermixed) for the fabric coverings. Similarly, the broader aspects of the present invention are intended to cover and include variations in the thickness, density, indentation load deflection ratings, and other characteristics of the foam component for each mattress made in accordance with this invention. Still further, while specific language has been used in describing the exemplary preferred embodiments discussed above, it should be appreciated that such language is by way of description and example only and is not limiting to the present invention which is further set forth below in the appended claims.

What is claimed is:

1. A portable support pad, comprising:

an integral foam member comprising a generally rectangular shaped planar layer generally of a predetermined, constant thickness in a range from about one-fourth of an inch to about one inch thick;

fabric coverings received on both sides of said foam member layer and received about the edges of said layer so that said foam member is fully encased;

generally straight-line stitching through said pad at spaced intervals therealong so as to secure said fabric coverings to said foam member, said spaced intervals being generally no greater than about two and one-half inches, and said spaced stitching extending laterally relative said generally rectangular shaped foam member layer so that said pad may be rolled up in a longitudinal direction perpendicular to the direction of said stitching; and elastic strap means comprising at least one integral loop secured at one end of said pad and functional when said pad is rolled up for surrounding said pad and elastically maintaining same in such rolled up condition.

2. A pad as in claim 1, wherein at least one of said fabric coverings comprises terry cloth material.

3. A pad as in claim 1, wherein said planar layer is generally about one-half of an inch thick, and said pad is generally rectangular with dimensions of approximately twenty inches by seventy inches so as to fit on conventional lounge furniture, such as a chaise lounge.

4. A pad as in claim 1, wherein said planar layer is generally flat.

5. A pad as in claim 1, wherein said planar layer is convoluted on at least one side thereof.

6. A pad as in claim 1, wherein at least one of said fabric coverings has a nonskid exterior finish.

7. A pad as in claim 1, wherein said pad further includes a fabric-covered foam pillow attached thereto.

8. A pad as in claim 1, further including an exterior layer of material which is air permeable but moisture impermeable.

9. A pad as in claim 1, wherein all of said intervals are substantially the same and are generally in a range from about one-half of an inch to about one and one-half inches.

10. A portable support pad as in claim 1, wherein said fabric coverings comprise separate layers of fabric material.

11. A portable support pad as in claim 10, wherein said fabric coverings further include folded edging received about the peripheral edges of said foam member and stitched into position about the outer faces of said separate layers of fabric material so as to reinforce lateral ends of said straight-line stitching.

12. A portable support pad as in claim 1, wherein said spaced intervals are generally the same and are generally about one inch.

13. A portable support pad as in claim 1, wherein said spaced intervals alternate generally between being about one inch and about two inches wide.

14. A portable support pad as in claim 1, wherein said strap means comprise a pair of elastic bands with their respective ends secured at common points for each band on said pad so that when said pad is rolled up said elastic bands may be placed in a loop thereabout.

15. A padded removable covering for a chaise lounge or similar primary support, comprising a fabric-encased integral foam layer with stitching therethrough to secure the fabric to said foam layer, and a pair of integral, elastic loops secured to one end of said covering for elastically maintaining said covering in a rolled up condition, wherein said stitching is in spaced substantially straight lines to form channels which facilitate rolling up said covering, wherein said fabric is washable, wherein the thickness of said foam layer is generally of a predetermined, constant thickness and generally about one-half of an inch, and wherein said spacing between adjacent lines of stitching is generally in a range from about one-half of an inch to about two and one-half inches.

16. A padded removable covering as in claim 15, wherein fabric encasing said foam layer includes terry cloth material on at least one side of said foam layer.

17. A padded removable covering as in claim 15, wherein said terry cloth material is cotton, the fabric on the opposite side of said foam layer is manmade material, and said covering further includes a cotton terry cloth material edging about the entire periphery of said foam layer.

18. A padded removable covering as in claim 15, further including straps for securing said covering to a chaise lounge.

19. A padded removable covering as in claim 15, wherein said spacing between adjacent lines of stitching alternates widths in an approximate 1:2 ratio.

* * * * *